United States Patent [19]

Kiefer et al.

[11] Patent Number: 4,953,793

[45] Date of Patent: Sep. 4, 1990

[54] BOWL-AND-ROLLER MILL

[75] Inventors: Dieter Kiefer, Wesel-Bislich; Helmut Grommes, Duisburg, both of Fed. Rep. of Germany

[73] Assignee: Deutsche Babcock Werke Aktiengesellschaft, Oberhausen, Fed. Rep. of Germany

[21] Appl. No.: 373,986

[22] Filed: Jun. 29, 1989

[30] Foreign Application Priority Data

Jul. 1, 1988 [DE] Fed. Rep. of Germany ..... 3822290

[51] Int. Cl.[5] ..... B02C 15/00

[52] U.S. Cl. ..... 241/119; 241/300

[58] Field of Search ..... 241/300, 55, 117–121

[56] References Cited

U.S. PATENT DOCUMENTS 3,138,337 6/1964 Bogot et al. ..... 241/300 X

FOREIGN PATENT DOCUMENTS 717920 2/1942 Fed. Rep. of Germany ..... 241/121

1055926 4/1959 Fed. Rep. of Germany .

OTHER PUBLICATIONS

Aufbereitungs-Technik 12 (1971), pp. 542–543.

*Primary Examiner*—Mark Rosenbaum

*Attorney, Agent, or Firm*—Max Fogiel

[57] ABSTRACT

Accommodated inside the housing (1) of a bowl-and-roller mill is a rotating grinding bowl (3) with segments (7) that stationary rollers (8) roll over. Blades (20) are cast onto the outside circumference of a nozzle ring (15).

1 Claim, 2 Drawing Sheets

BOWL-AND-ROLLER MILL

The segments of the grinding bowl in bowl-and-roller mills (Aufbereitungs-Technik 12 [1971], 542 & 543) are cast from a wear-resistant material and, since they do wear out, are secured in a supporting shell in such a way that they can be replaced. A ring of nozzles that introduce hot conveying and drying air is accommodate stationary in the bowl housing. Since the nozzle ring is also subject to wear, it is sectioned horizontally, and the segmented upper half can be replaced. The unsegmented lower half and the segmented upper half of the nozzle ring are castings. The imprecision unavoidable in casting entails that the contour of the ring's blades may exhibit a displacement along the plane of separation.

The nozzle ring in another known bowl-and-roller mill (German Pat. No. 1 055 926) rotates along with the bowl, and the blades on the ring are distributed along the outer circumference of the bowl that supports the segments. The cross-section of the exit from the nozzle ring is demarcated by two wear-resistant rings, one mounted on the bowl and the other on the housing in such a way that they can be replaced. The whole bowl must be disassembled from this mill once the nozzle-ring blades become worn, and the blades themselves can only be repaired by specially armoring them.

The object of the present invention is to decrease the number of wear-subjected parts that must be replaced and increase the precision of the dimensions of the nozzle-ring blades.

This object is attained in accordance with the invention in a generic bowl-and-roller mill in that the nozzle-ring blades are cast onto the other circumference of the bowl segments. The wear-subjected parts, specifically the segments of the grinding bowl and of the nozzle ring, are accordingly integrated into a single replaceable component. The number of parts that have to be replaced is decreased by half. The replacement parts must be secured to only one single component, specifically the bowl, which also decreases maintenance costs by half. Since most of the nozzle-ring blades associated with one bowl segment are cast onto the total length of the segment, the blades will have a continuous contour.

Figure 1:
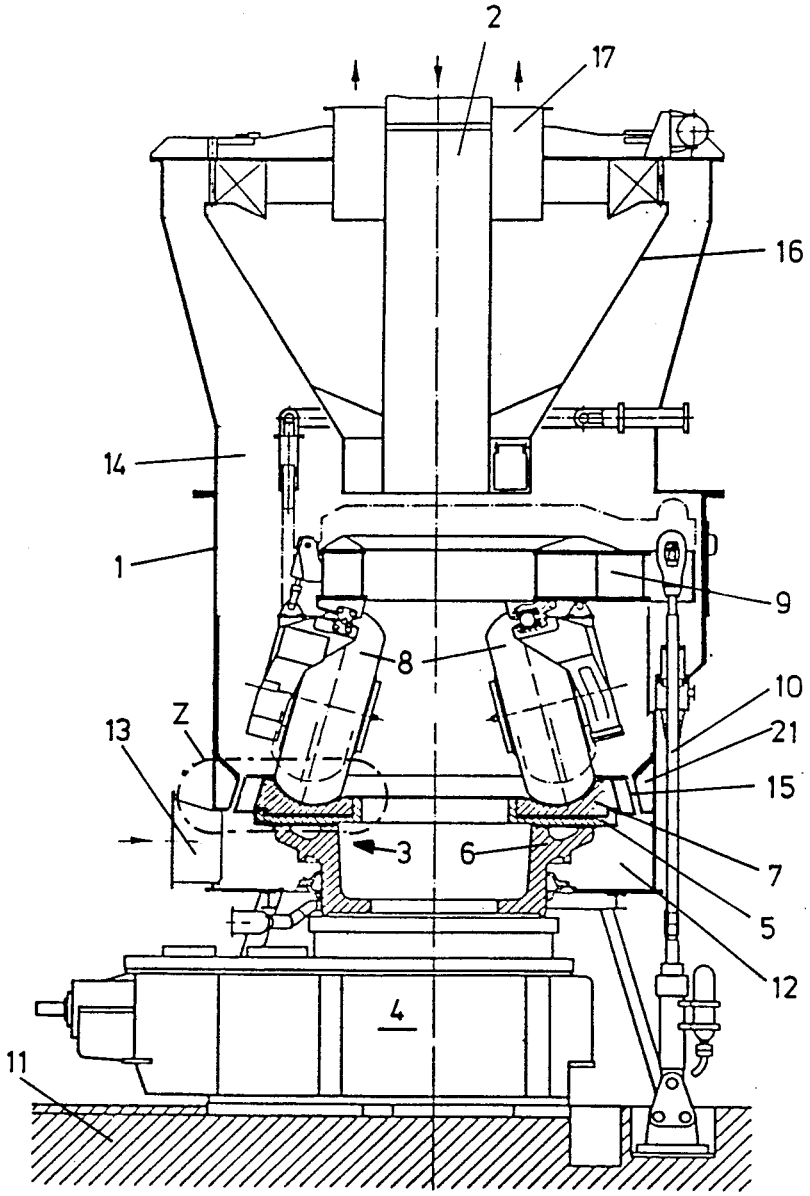
Figure 2:
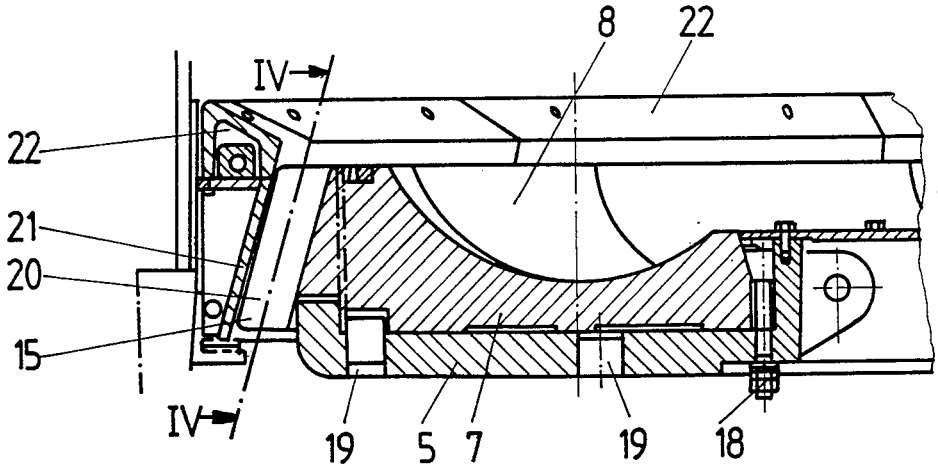
Figure 3:
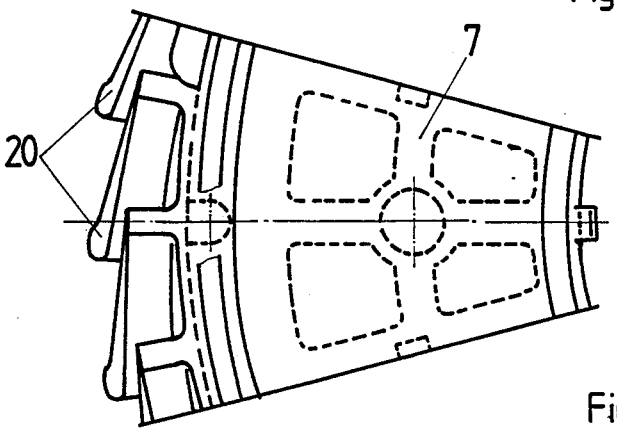
Figure 4:
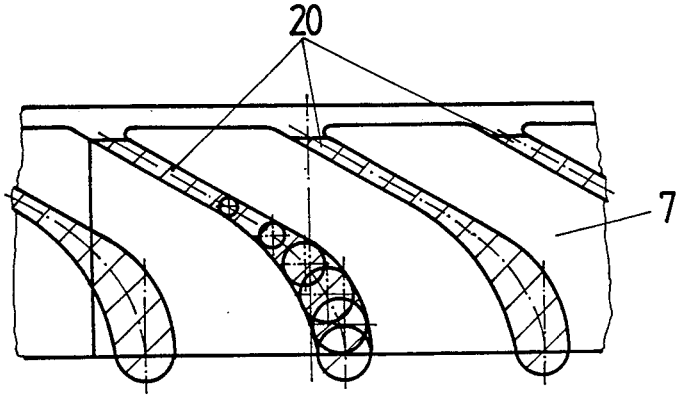

One embodiment of the invention will now be described in detail with reference to the drawing, wherein FIG. 1 is a longitudinal section through a bowl-and-roller mill, FIG. 2 is a larger-scale representation of the detail Z in FIG. 1, FIG. 3 is a top view of one segment of the bowl, and FIG. 4 is a section along the line IV—IV in FIG. 2.

The bowl-and-roller mill has a housing 1 with a riser 2 for feeding crude coal extending through it. Inside housing 1 is a horizontal rotating grinding bowl 3 that is driven by an unillustrated motor by way of a transmission 4. Bowl 3 contains a supporting shell 5 that is attached to a bowl support 6 resting on transmission 4. Mounted on supporting shell 5 are bowl segments 7 that constitute a race for the stationary rollers 8 to roll over. Rollers 8 rest on a frame 9 that is resiliently tensioned against the base 11 of the mill by way of rods 10. The tensioning system resiliently forces rollers 8 against bowl 3.

At the bottom of housing 1 and below bowl 3 is an air box 12 equipped with air-supply connections 13. The bottom of air box 12 is floored and communicates with a grinding area 14 inside housing 1 by way of a ring 15 of nozzles. Resting on housing 1 is a funnel 16, into which extends a dust-removal line 17. A drying and conveying gas in the form of hot air is introduced into air box 12 through air-supply connections 13. The air flows into grinding area 14 through nozzle ring 15, intercepts the cloud of dust generated by the action of rollers 8 on bowl 3, and removes it through funnel 16 and dust-removal line 17.

Nozzle ring 15 and bowl 3 are illustrated in detail in FIGS. 2 and 4. The walls of bowl segments 7 are at an angle of 30°, with twelve such segments constituting the race. The segments are secured to the shell 5 that supports bowl 3 by screws 18 and blocks 19 and can be removed from the shell.

Cast onto the outside circumference of each bowl segment 7 are the blades 20 that constitute nozzle ring 15. Bowl segments 7 and blades 20 constitute a single component, which is cast from a wear-resistant material.

Blades 20 slant along the direction that bowl 3 rotates in, with an angle of 90° at the arriving-flow edge and an angle of 30° to the horizontal at the departing-flow edge. Blades 20 are preferably oriented radially toward the center of bowl 3. Each blade 20 axially overlaps the flow-arrival departing-flow cross-section between two adjacent blades. Rectangular exit surfaces are created at the departing-flow side between each pair of adjacent blades 20 and the outside circumference of a bowl segment 7.

Nozzle ring 15, which, due to the aforesaid design, rotates along with bowl 3, is demarcated at the wall of housing 1 by slanting plates 21 that project forward at the upper edge and follow the slope of the outer edge of blades 20. These structures create channels that slant up into housing 1. Above plates 21 are angled structural sections 22 that, like the plates, are secured to and can be released from the wall of housing 1. The outer cross-section of plates 21 and structural sections 22 is triangular.

I claim:

1. A roller bowl mill comprising: a housing; a rotating grinding bowl in said housing; said grinding bowl having a replaceable grinding track element attached to said grinding bowl; stationary rollers rolling over said grinding track element; said grinding track element comprising individual grinding bowl segments; a nozzle ring surrounding said grinding bowl; said nozzle ring being formed of nozzle ring segments; blades on said nozzle ring; said blades being formed on the outer periphery of the individual grinding bowl segments; each grinding bowl segment forming with a corresponding nozzle ring segment a single replaceable and interchangeable part.

* * * * *